US011311984B2

(12) United States Patent
Li

(10) Patent No.: US 11,311,984 B2
(45) Date of Patent: Apr. 26, 2022

(54) DIRECTION CONTROLLER FOR A RATCHET WRENCH

(71) Applicant: Yi-Min Li, Taichung (TW)

(72) Inventor: Yi-Min Li, Taichung (TW)

( * ) Notice: Subject to any disclaimer, the term of this patent is extended or adjusted under 35 U.S.C. 154(b) by 368 days.

(21) Appl. No.: 16/507,041

(22) Filed: Jul. 10, 2019

(65) Prior Publication Data

US 2021/0008695 A1 Jan. 14, 2021

(51) Int. Cl.
*B25B 13/46* (2006.01)
*B25B 23/00* (2006.01)

(52) U.S. Cl.
CPC ..... *B25B 13/463* (2013.01); *B25B 23/0007* (2013.01)

(58) Field of Classification Search
CPC ..... B25B 13/463; B25B 23/0007
See application file for complete search history.

(56) References Cited

U.S. PATENT DOCUMENTS 7,165,479 B1 * 1/2007 Lee ..... B25B 13/463 81/60
9,205,538 B2 * 12/2015 Yang ..... B25B 13/463
9,931,737 B2 * 4/2018 Kao ..... B25B 13/463
2019/0344406 A1 * 11/2019 Chen ..... B25B 23/0057

* cited by examiner

*Primary Examiner* — Hadi Shakeri
(74) *Attorney, Agent, or Firm* — Bruce Stone LLP; Joseph A. Bruce

(57) ABSTRACT

A ratchet wrench includes a box, a button, a switch and an engagement element. The box includes an upper opening, a channel, a switch chamber in communication with the upper opening via the channel, and a button aperture in communication with the switch chamber. The button is inserted in the switch chamber via the button aperture. The button includes an abutment portion to keep the button in the box. The switch includes an arched portion extending in the switch chamber around the button. The switch is operable to rotate the button by the abutment portion without hindering movement of the button into and from the button aperture of the box. The engagement element is inserted in the channel of the box. The abutment portion is operable to move the engagement element in the channel to extend a front edge from the upper opening of the box.

14 Claims, 10 Drawing Sheets

DIRECTION CONTROLLER FOR A RATCHET WRENCH

BACKGROUND OF INVENTION

1. Field of Invention

The present invention relates to a ratchet wrench and, more particularly, to a direction controller for a ratchet wrench.

2. Related Prior Art

There are various wrenches such as ratchet wrenches. A conventional ratchet wrench includes a gear formed with a square insert that can be inserted in a square bore made in an end of a socket for example. The socket includes a hexagonal bore at an opposite end. The hexagonal bore can contain a nut or a head of a threaded bolt. Thus, the ratchet wrench is operable to rotate the nut or the threaded bolt via the socket. However, this conventional ratchet is not operable to rotate a nut or threaded bolt without a socket.

Another conventional ratchet wrench includes a gear made with a bore for containing a nut or a head of a threaded bolt. Thus, the ratchet wrench is operable to rotate the nut or the threaded bolt. However, the racket wrench has to be used with an extensive element to rotate a nut or a threaded bolt located in a deep place. The extensive element includes a polygonal insert at an end and a socket at another end. The polygonal insert is inserted in the bore of the gear. The socket can receive the nut or the head of the threaded bolt. Thus, the ratchet wrench is operable to rotate the nut or the threaded bolt via the extensive element. However, the extensive element could easily be disengaged from the gear.

The present invention is therefore intended to obviate or at least alleviate the problems encountered in prior art.

SUMMARY OF INVENTION

It is the primary objective of the present invention to provide a convenient and reliable ratchet wrench.

To achieve the foregoing objective, the ratchet wrench includes a box, a button, a switch and an engagement element. The box includes an upper opening, a channel, a switch chamber in communication with the upper opening via the channel, and a button aperture in communication with the switch chamber. The button is inserted in the switch chamber via the button aperture. The button includes an abutment portion to keep the button in the box. The switch includes an arched portion extending in the switch chamber around the button. The switch is operable to rotate the button by the abutment portion without hindering movement of the button into and from the button aperture of the box. The engagement element is inserted in the channel of the box. The abutment portion is operable to move the engagement element in the channel to extend a front edge from the upper opening of the box.

Other objectives, advantages and features of the present invention will be apparent from the following description referring to the attached drawings.

BRIEF DESCRIPTION OF DRAWINGS

The present invention will be described via detailed illustration of the preferred embodiment referring to the drawings wherein.

DETAILED DESCRIPTION OF PREFERRED EMBODIMENT

Figure 1:
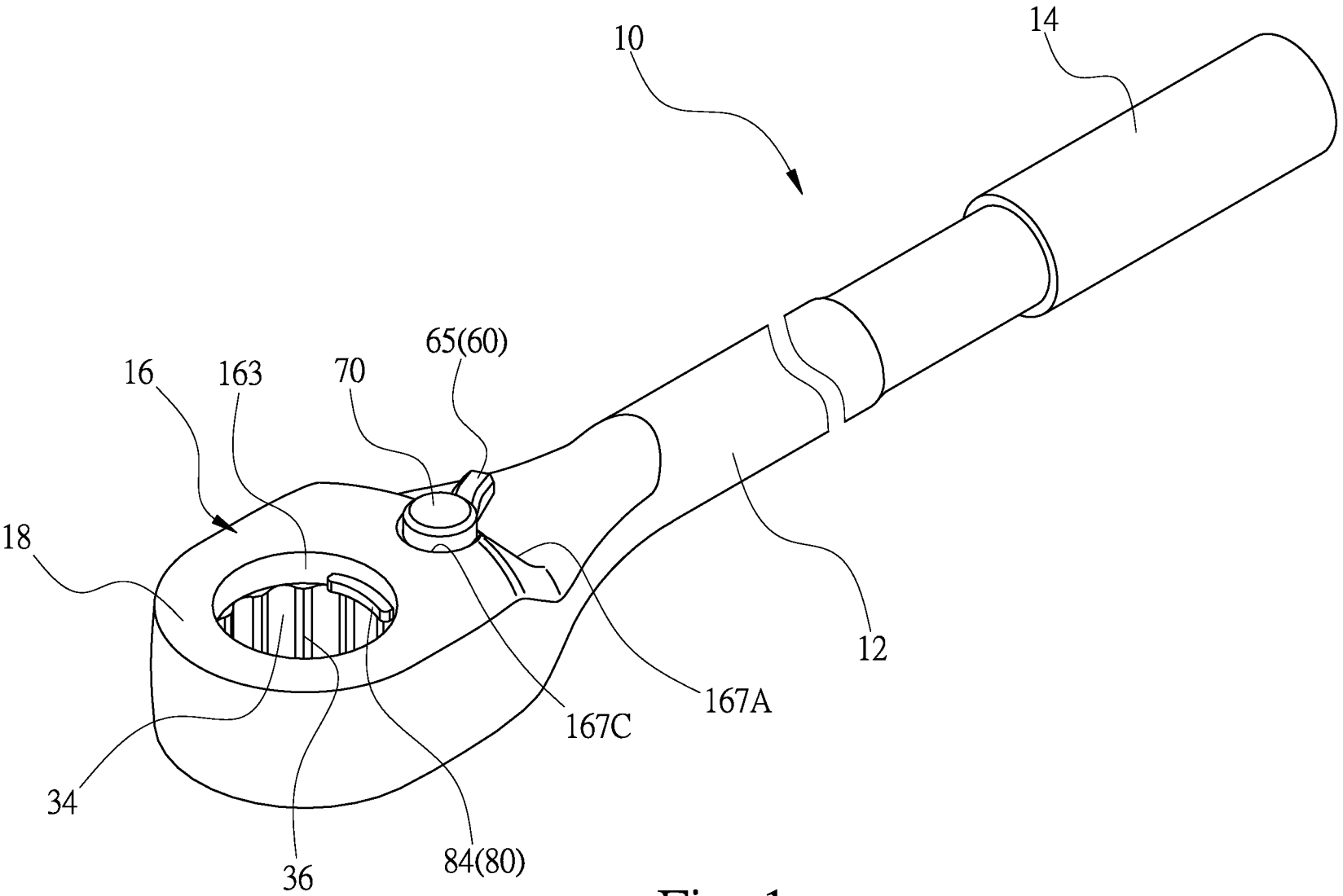
FIG. 1 is a perspective view of a ratchet wrench according to the preferred embodiment of the present invention.
Figure 2:
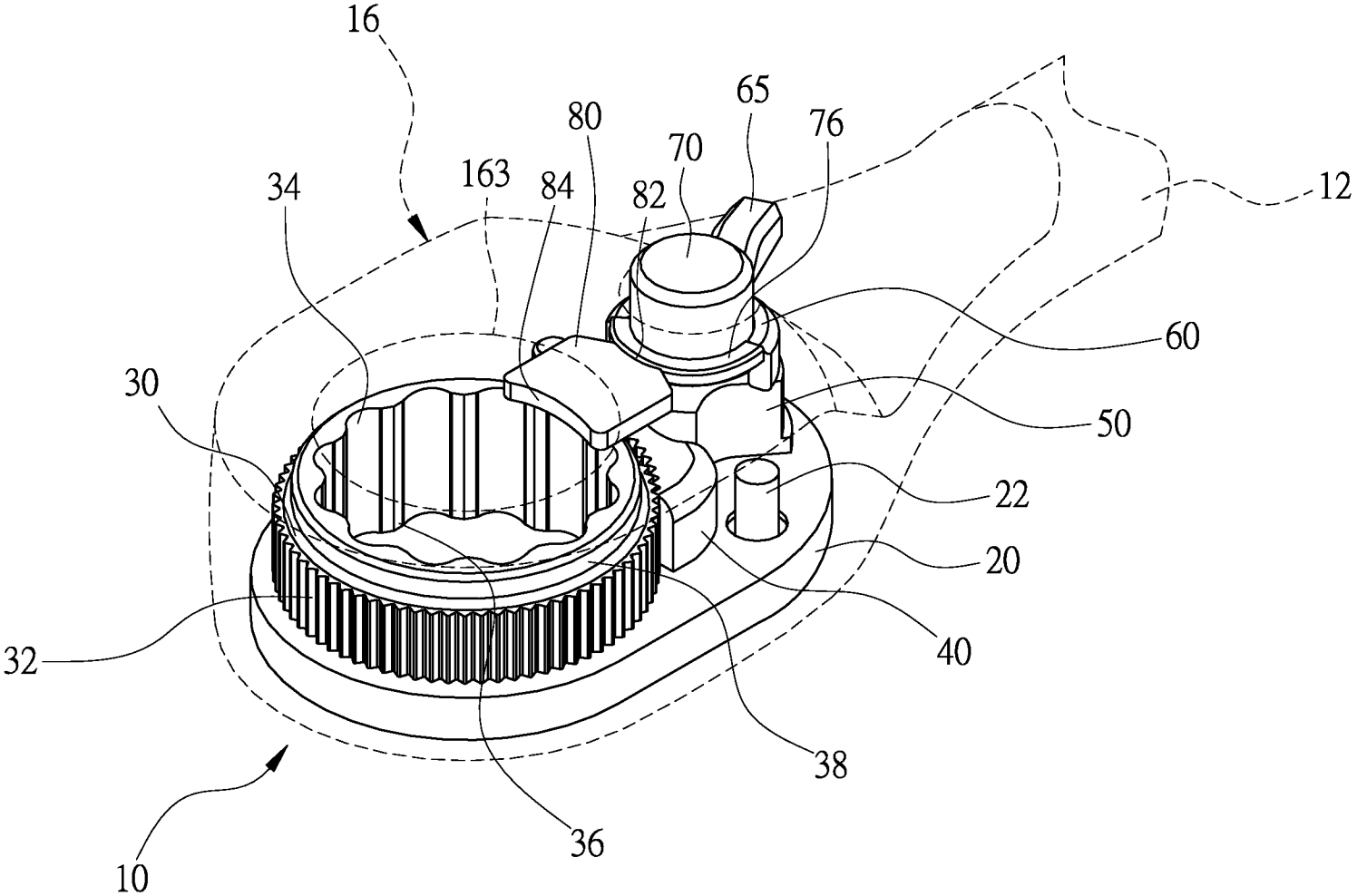
FIG. 2 is a perspective view of a direction controller of the ratchet wrench shown in FIG. 1.

Referring to FIGS. 1 and 2, a ratchet wrench 10 includes a handle (not numbered), a cover 20, a gear 30, a pawl 40 and a direction controller in according to the preferred embodiment of the present invention. The handle includes a shank 12 formed between a grip 14 and a box 16. The shank 12, the grip 14 and the box 16 are made in one piece. The grip 14 is operable to spin the box 16 via the shank 12, thereby rotating a threaded bolt or a nut for example.

Referring to FIG. 2, the gear 30 and the pawl 40 are inserted in the box 16. The cover 20 is secured to the box 16 by fasteners 22 such as screws and rivets. Thus, the gear 30 and the pawl 40 are kept in the box 16 by the cover 20.

Figure 3:
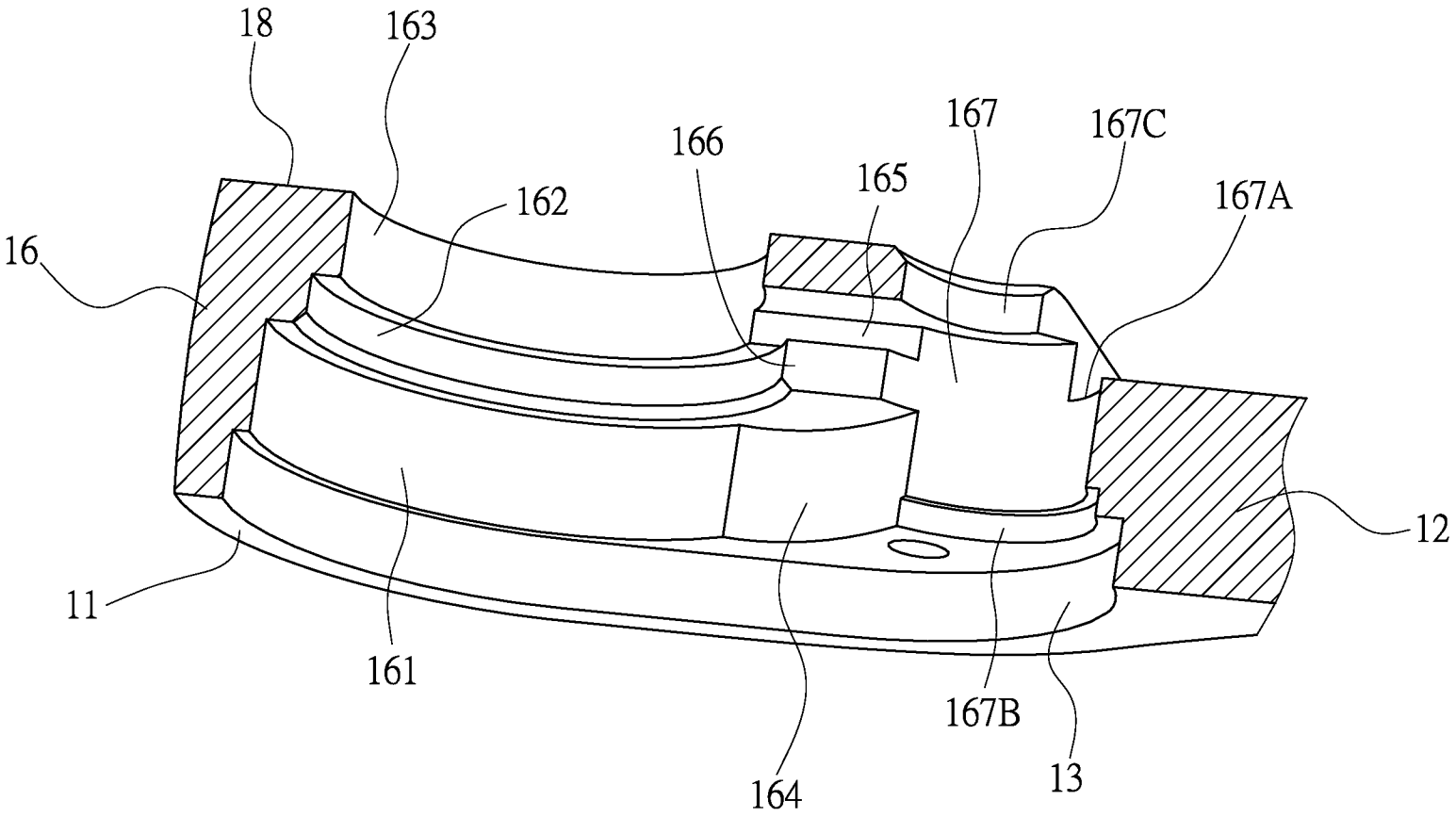
FIG. 3 is a partial, cross-sectional view of the ratchet wrench shown in FIG. 1.
Figure 5:
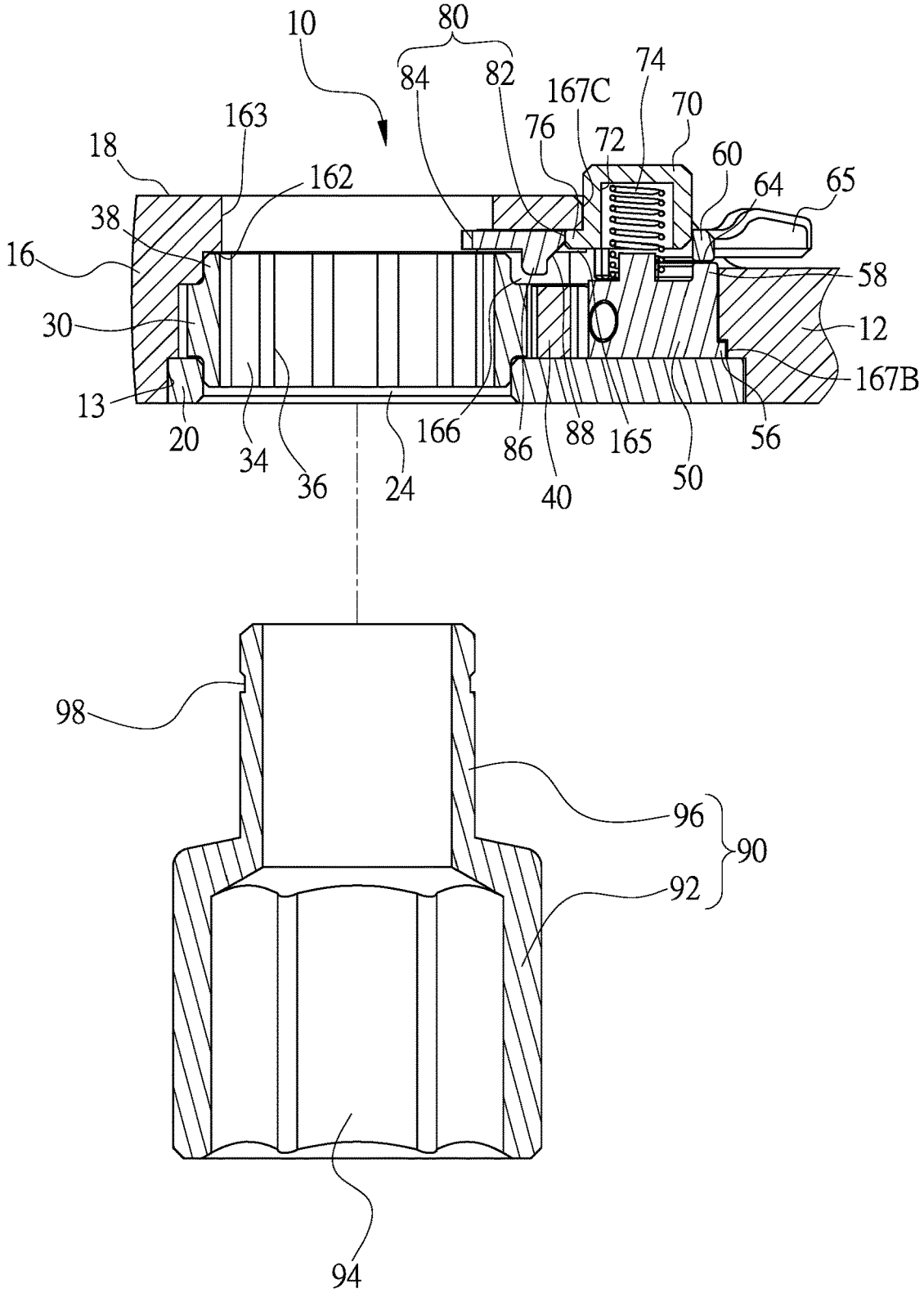
FIG. 5 is a cross-sectional view of an extensive element and the ratchet wrench shown in FIG. 1.
Figure 6:
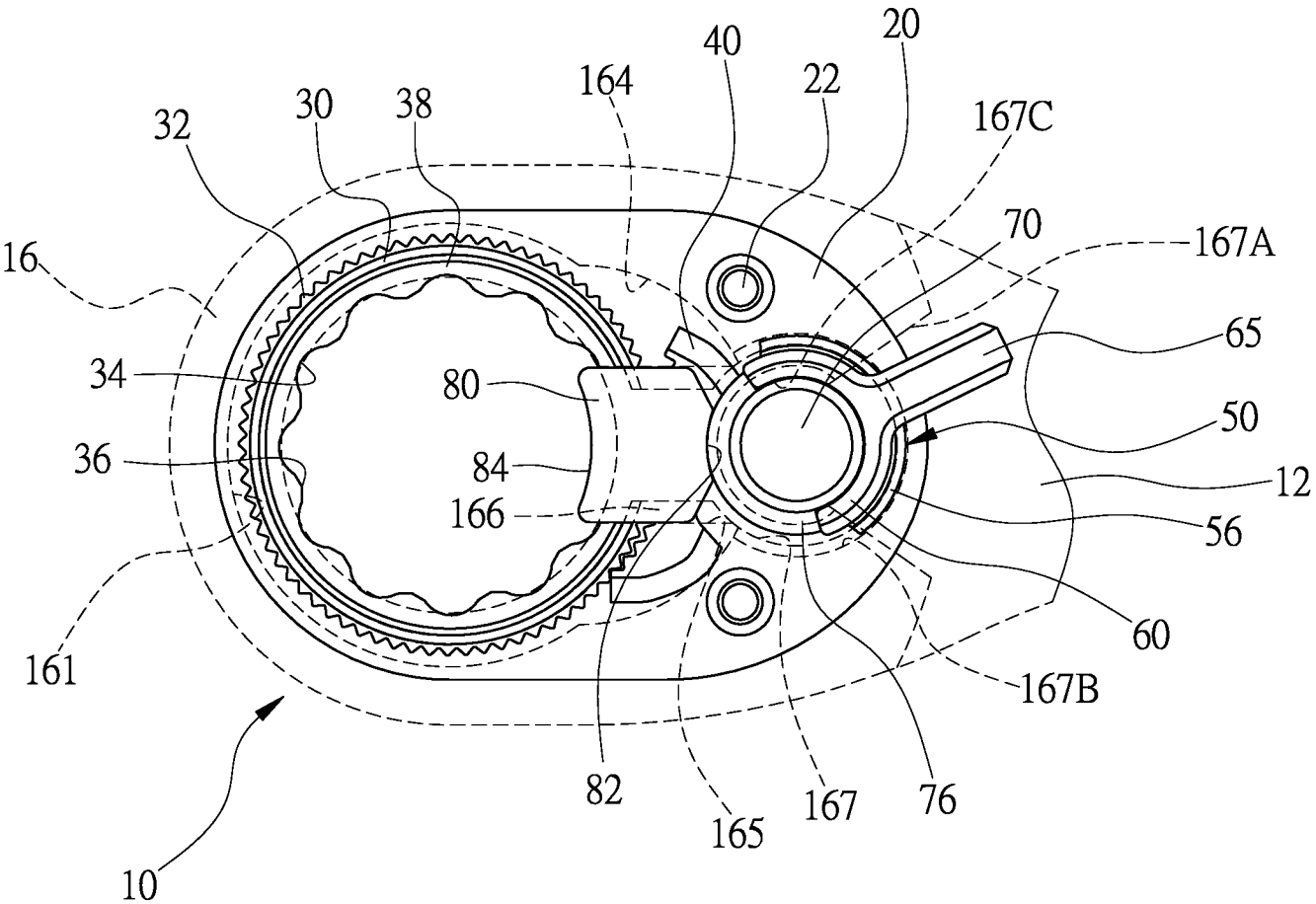
FIG. 6 is a top view of the direction controller shown in FIG. 2.
Figure 7:
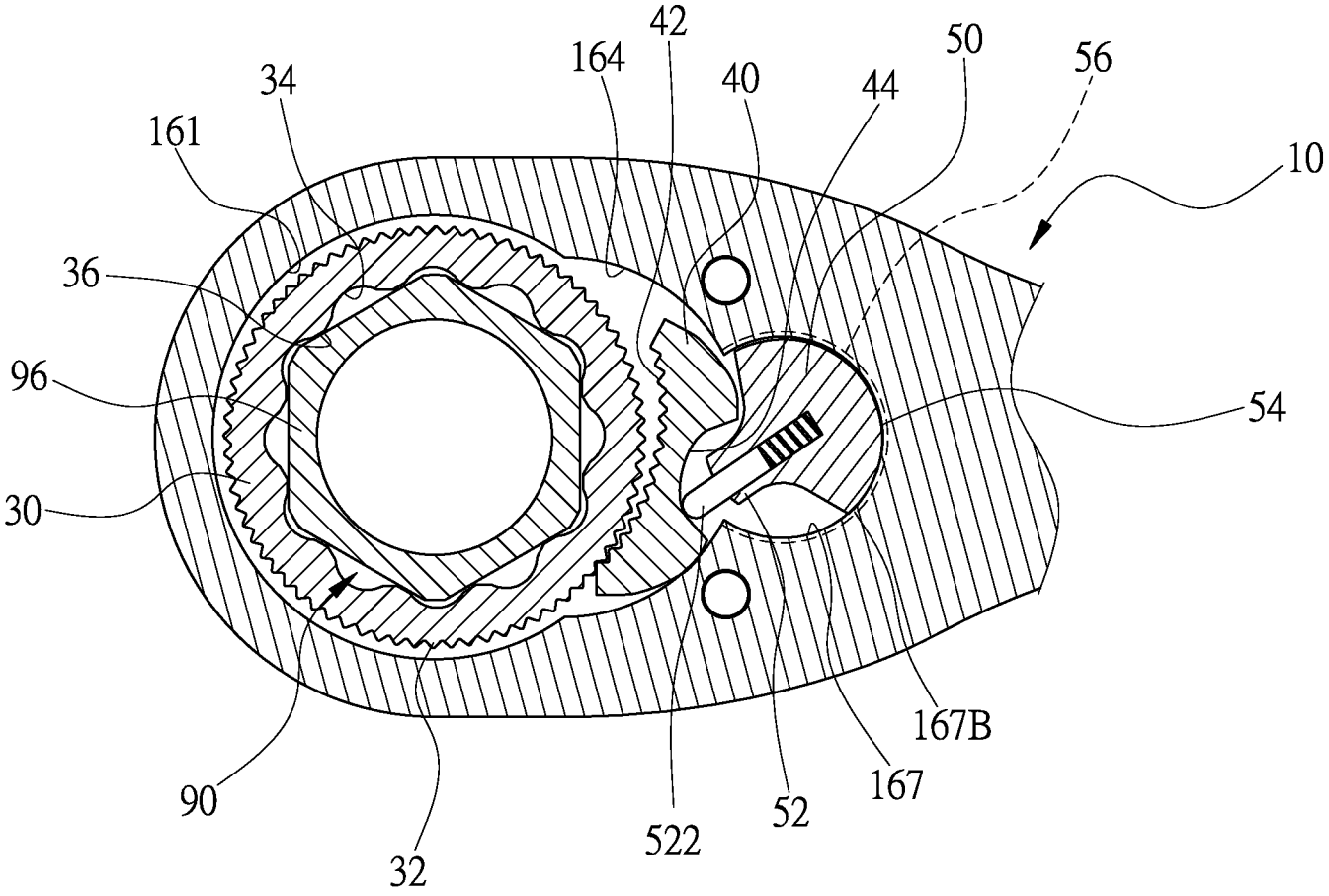
FIG. 7 is a cross-sectional view of the direction controller shown in FIG. 6.

Referring to FIGS. 3, 6 and 7, the box 16 is formed with a lower face 11, an upper face 18, a lower opening 13, a gear chamber 161, a restraining aperture 162 and an upper opening 163. The gear chamber 161 is located above the lower opening 13. The restraining aperture 162 is located above the gear chamber 161. The upper opening 163 is located above the restraining aperture 162. The cover 20 is inserted in the lower opening 13, thereby rendering a lower face of the cover 20 flush with the lower face 11 of the box 16 (FIG. 5). The lower opening 13, the gear chamber 161, the restraining aperture 162 and the upper opening 163 are in communication with one another. The lower opening 13 expands for a larger area than the gear chamber 161. The gear chamber 161 expands for a larger area than the restraining aperture 162. The restraining aperture 162 expands for a larger area than the upper opening 163.

The box 16 includes a switch chamber 167, a slot 167A, a flange chamber 167B and a button aperture 167C. The flange chamber 167B is in communication with the lower opening 13. The flange chamber 167B expands for a smaller area than the lower opening 13. The switch chamber 167 is located above and in communication with the flange chamber 167B. The switch chamber 167 expands for a smaller a rear than the flange chamber 167B so that there is a shoulder (not numbered) between the switch chamber 167 and the flange chamber 167B. The button aperture 167C is located above and in communication with the switch chamber 167. The button aperture 167C expands for a smaller a rear than the switch chamber 167. In specific, the button aperture 167C is made in the upper face 18, next to the upper opening 163. The slot 167A is made in the upper face 18, next to the button aperture 167C, in the vicinity of the shank 12. The slot 167A is in communication with the switch chamber 167.

The box 16 includes a pawl chamber 164, a channel 165 and a passageway 166. The pawl chamber 164 is a crescent chamber that includes a concave side and a convex side. The pawl chamber 164 is in communication with the gear chamber 161 on the concave side. The pawl chamber 164 is in communication with the switch chamber 167 and the flange chamber 167B on the convex side. In a direction of the thickness of the box 16, the pawl chamber 164 is in communication with the channel 165 via the passageway 166. In a direction of the length of the box 16, the restraining aperture 162 is in communication with the switch chamber 167 via the passageway 166.

Referring to FIGS. 2, 3 and 5, the gear 30 and the pawl 40 will be described in detail. Two opposite axles 38 extend from the gear 30. One of the axles 38 is inserted in the restraining aperture 162 of the box 16. The remaining one of the axles 38 is inserted in a restraining aperture 24 made in the cover 20. Thus, the gear 30 is allowed to spin smoothly in the gear chamber 161, relative to the box 16.

The gear 30 is hollow or annular element that includes an external side and an internal side. Teeth 32 are formed on the external side of the gear 30. Teeth 36 are formed on the internal side of the gear 30. The teeth 36 are separated from one another by gaps 34. The teeth 36 are larger than the teeth 32.

Referring to FIG. 7, the pawl 40 includes a concave side and a substantially convex side. Teeth 42 are formed on the concave side of the pawl 40. A concave face 44 is formed on the substantially convex side of the pawl 40. The teeth 42 are directed to the gear chamber 161 and the concave face 44 is directed to the switch chamber 167 when the pawl 40 is inserted in the pawl chamber 164 of the box 16.

Figure 4:
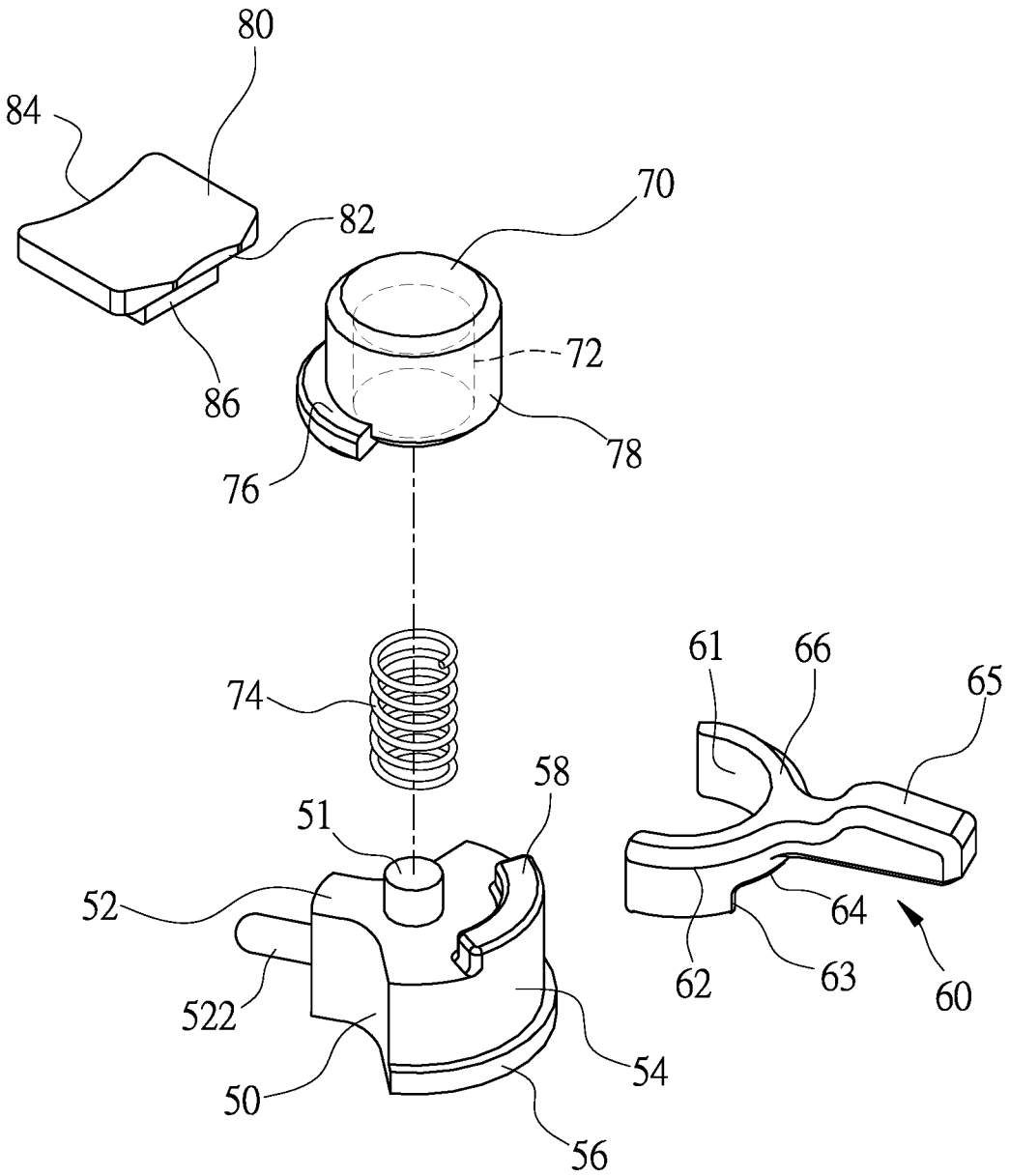
FIG. 4 is an exploded view of the direction controller shown in FIG. 2.

Referring to FIG. 4, the direction controller includes a rotor 50, a switch 60, a button 70, a compression spring 74 and an engagement element 80. The rotor 50 includes a boss 51, a radial protrusion 52, a convex face 54, an arched flange 56 and an arched ridge 58. The boss 51 and the arched ridge 58 extend from an upper face of the rotor 50. The arched ridge 58 extends around the boss 51. The radial protrusion 52 extends from a front side of the rotor 50. The convex face 54 extends on a rear side of the rotor 50. The boss 51 is located between the radial protrusion 52 and arched ridge 58. An elastic positioning element 522 is connected to the radial protrusion 52. Preferably, the elastic positioning element 522 is spring-biased detent. The arched flange 56 extends from the convex face 54 and along a lower edge of the convex face 54.

Referring to FIGS. 5 and 7, the convex face 54 is shaped in compliance with a wall of the switch chamber 167. Thus, the rotor 50 is rotatable relative to the box 16 and the arched flange 56 is movable in the flange chamber 167B when the rotor 50 is inserted in the switch chamber 167 of the box 16. The rotor 50 cannot be moved toward the button aperture 167C since the arched flange 56 is limited by the shoulder between the switch chamber 167 and the flange chamber 167B. The rotor 50 cannot be moved out of the box 16 because the arched flange 56 is limited by the cover 20. The radial protrusion 52 is inserted in the pawl chamber 164, with a tip of the elastic positioning element 522 abutted against the concave face 44. Thus, the pawl 40 is pushed toward the gear 30, and some of the teeth 42 are engaged with some of the teeth 32. Hence, the gear 30 can be rotated by the box 16 when the box 16 is rotated in a sense of direction, but the gear 30 cannot be rotated by the box 16 when the box 16 is rotated in an opposite sense of direction.

For example, the wall of the pawl chamber 164 of the box 16 pushes the pawl 40 toward the gear 30 as the ratchet wrench 10 is rotated counterclockwise referring to FIG. 7. Thus, some of the teeth 42 are engaged with some of the teeth 32, thereby allowing the box 16 to impose a torque on the gear 30 via the pawl 40. Accordingly, the box 16 rotates the gear 30 counterclockwise.

The wall of the pawl chamber 164 of the box 16 is moved away from the pawl 40 to allow the pawl 40 to be moved away from the gear 30 when the ratchet wrench 10 is rotated clockwise referring to FIG. 7. Thus, the teeth 32 can be disengaged from and are allowed to rattle on the teeth 42 so that the box 16 cannot exert any torque on the gear 30. Hence, the box 16 spins clockwise without rotating the gear 30.

Referring to FIG. 4, the switch 60 is formed with an arched portion 66, two pushers 63 and a lever 65. The arched portion 66 of the switch 60 includes a concave face 61 and a convex face 62. The lever 65 extends from the convex face 62 in a radial manner. The pushers 63 extend from a lower face of the arched portion 66 of the switch 60 and separated from each other by a recess 64.

Referring to FIGS. 1 and 4 through 6, the arched portion 66 of the switch 60 is inserted in the switch chamber 167 of the box 16 as the lever 65 extends out of the box 16 through the slot 167A. An upper portion of the box 16 restrains the arched portion 66 of the switch 60 to keep the arched portion 66 of the switch 60 in the switch chamber 167. The slot 167A limits the pivoting of the lever 65 to a proper range. The recess 64 contains the arched ridge 58 and that each of the pushers 63 is located next to one of two ends of the arched ridge 58. Thus, the lever 65 is operable to rotate the rotor 50 that in turns moves the pawl 40 relative to the gear 30 in a manner to be described later. The convex face 62 of the switch 60 and the convex face 54 of the rotor 50 are compliant to the wall of the switch chamber 167 to allow smooth rotation of the switch 60 and the rotor 50 in the switch chamber 167 relative to the box 16.

Referring to FIG. 4, the button 70 includes an upper end for contact with a user's finger. A spring bore 72 is made in a lower end of the button 70. An abutment portion 76 is in the form of an annular flange extending on a periphery 78 of the button 70, along a lower edge of the button 70.

Referring to FIGS. 5 and 6, the button 70 is inserted in the switch chamber 167 of the box 16. The compression spring 74 is located between the button 70 and the rotor 50 so that the upper end of the button 70 extends from the box 16 via the button aperture 167C while the periphery 78 of the button 70 is sliding on the concave face 61 of the switch 60. Then, the abutment portion 76 is abutted against the upper portion of the box 16 so that the button 70 cannot be moved from the box 16 through the button aperture 167C. An end of the compression spring 74 is inserted in the spring bore 72 and another end of the compression spring 74 is located around the boss 51, thereby keeping the compression spring 74 in position. Two ends of the arched portion 66 of the switch 60 are abutted against two ends of the abutment portion 76 of the button 70 so that the switch 60 is operable to rotate the button 70.

Referring to FIGS. 4 through 6, the engagement element 80 is in the form of a plate including a rear edge 82, a front edge 84, a fin 86 and an inclined face 88. The fin 86 extends from a lower face of the engagement element 80. The engagement element 80 is inserted in the channel 165 and movable relative to the box 16. The rear edge 82 is a concave edge in contact with the abutment portion 76 to determine a minimum portion of the engagement element 80 (including the front edge 84) that is exposed to the exterior of the box 16 via the upper opening 163. The fin 86 is inserted in the passageway 166, in contact with the axle 38, thereby determining a maximum portion of the engagement element 80 (including the front edge 84) that is exposed to the exterior of the box 16 via the upper opening 163. The inclined face 88 extends to the fin 86 from the rear edge 82.

Referring to FIG. 5, the ratchet wrench 10 is to be engaged with an extensive element 90. The extensive element 90 includes a socket 92 at an end and an insert 96 at another end. The socket 92 includes a polygonal recess 94 such as a hexagonal recess. The insert 96 includes a polygonal periphery such as a hexagonal periphery in which an annular groove 98 is made. The insert 96 is hollow in the preferred embodiment. However, the insert 96 can be solid in another embodiment. The socket 92 can be replaced with an insert in another embodiment.

Figure 8:
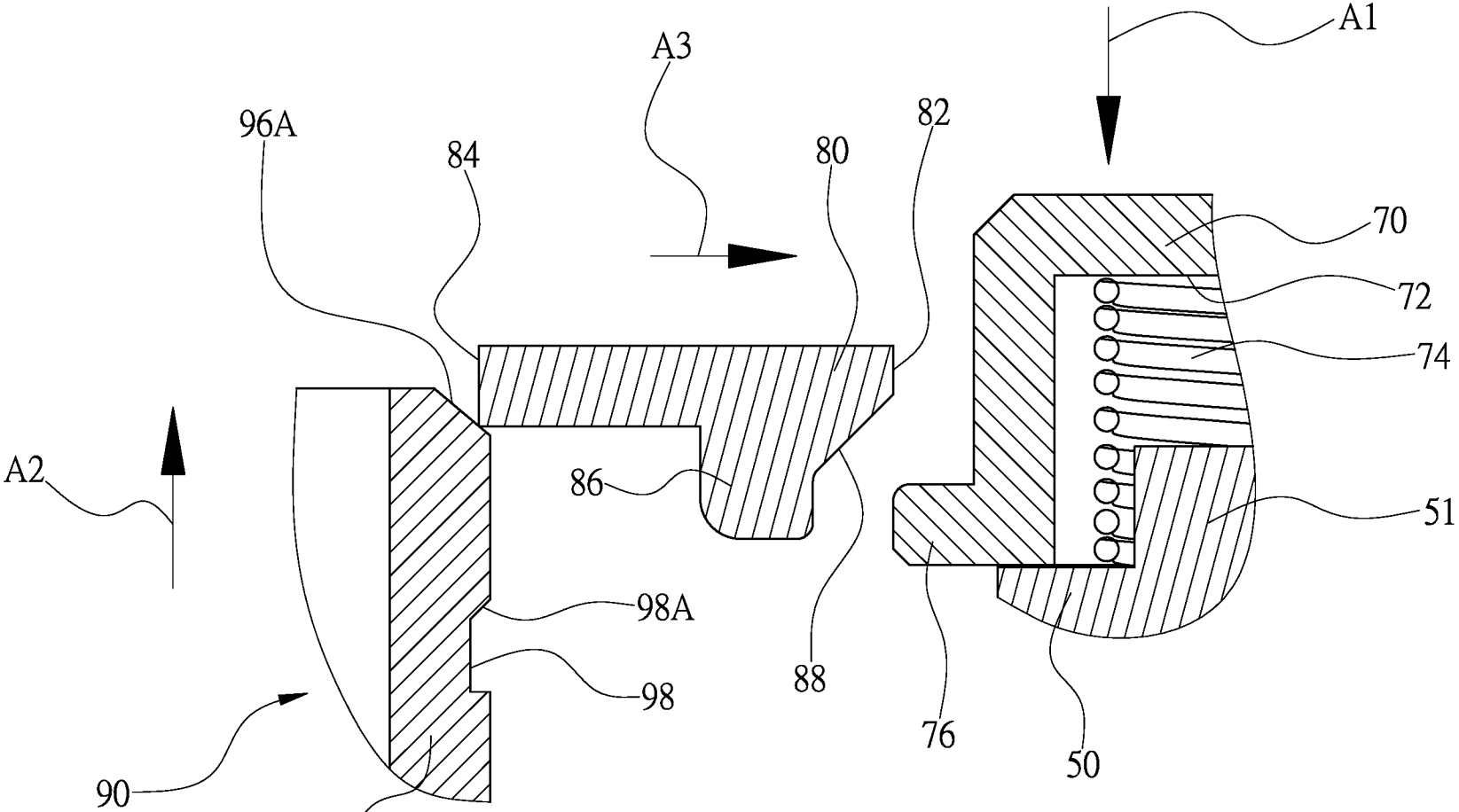
FIG. 8 is a partial view of the extensive element connected to the ratchet wrench shown in FIG. 5.

Referring to FIG. 8, the insert 96 includes an assembling inclined face 96A at an end. There is a dismantling inclined face 98A at a side of the annular groove 98. The dismantling inclined face 98A extends in a different direction than the assembling inclined face 96A.

An external force is used to push the button 70 as indicated by an arrow head A1, thereby moving the abutment portion 76 away from the rear edge 82. At the same time, the compression spring 74 is compressed by the button 70 and the rotor 50. The insert 96 is inserted in gear 30 (FIG. 7) as indicated by an arrow head A2. Accordingly, the assembling inclined face 96A is brought into contact with the front edge 84, thereby pushing the engagement element 80 into the channel 165 (FIG. 6) as indicated by an arrow head A3. Now, the engagement element 80 does not block the insert 96.

Figure 9:
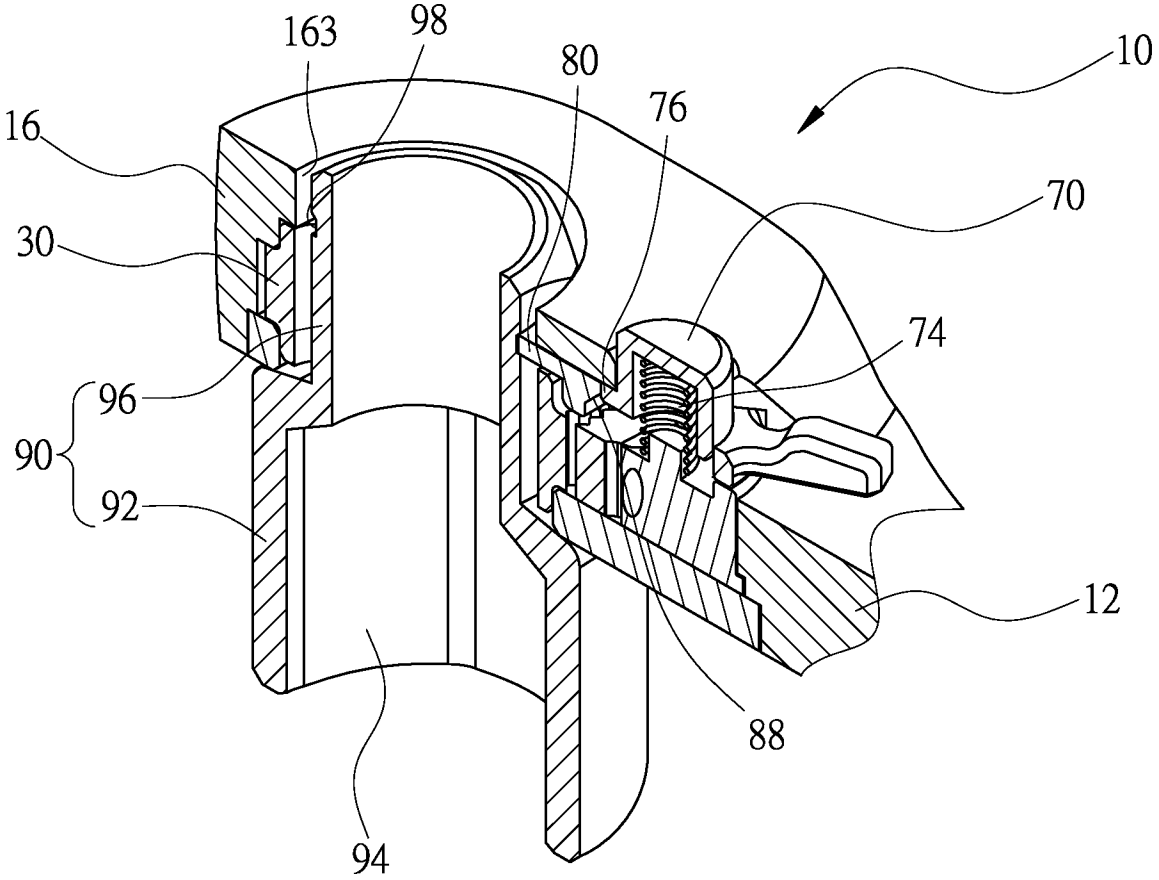
FIG. 9 is a cut-away view of the extensive element and the ratchet wrench shown in FIG. 5.

Referring to FIG. 9, an upper end of the insert 96 is inserted in the upper opening 163 of the box 16 through the gear 30. The button 70 is released from the external force to allow the compression spring 74 to return the button 70 to the original position. The abutment portion 76 is lifted accordingly to abut against the inclined face 88 to extend at least the front edge 84 of the engagement element 80 into the upper opening 163. The front edge 84 of the engagement element 80 is inserted in the annular groove 98 (FIG. 10) so that the box 16 is engaged with the extensive element 90.

Referring to FIG. 7, the angles of the insert 96 are inserted in some of the gaps 34 of the gear 30 so that the insert 96 is in contact with the tips 36. Thus, the ratchet wrench 10 is operable to rotate the extensive element 90.

Figure 10:
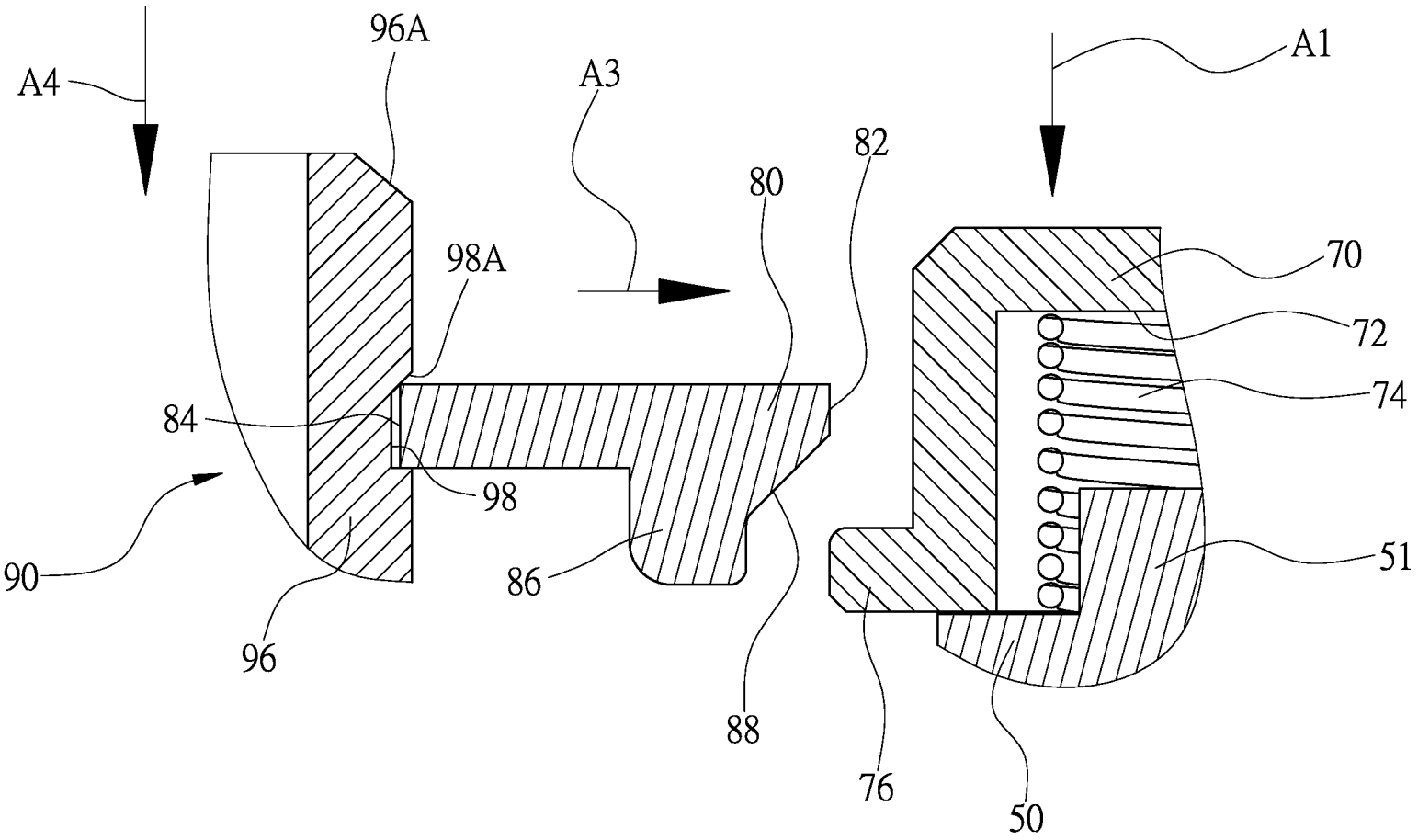
FIG. 10 is a partial view of the extensive element disconnected from the ratchet wrench shown in FIG. 5.

Referring to FIG. 10, the extensive element 90 is to be disengaged from the ratchet wrench 10. To this end, the button 70 is pushed as indicated by the arrow head A1 to move the abutment portion 76 away from the rear edge 82. Thus, the engagement element 80 is allowed to move.

Then, the extensive element 90 is moved as indicated by an arrow head A4 to cause the dismantling inclined face 98A to contact the front edge 84. The engagement element 80 is withdrawn into the channel 165 (FIG. 6) as indicated by an arrow head A3 so that the front edge 84 of the engagement element 80 is moved from the annular groove 98. Hence, the insert 96 can be disengaged from the ratchet wrench 10 (FIG. 5).

The present invention has been described via the illustration of the preferred embodiment. Those skilled in the art can derive variations from the preferred embodiment without departing from the scope of the present invention. Therefore, the preferred embodiment shall not limit the scope of the present invention defined in the claims.

The invention claimed is:

1. A ratchet wrench comprising:

a box comprising:

an upper opening;

a channel;

a switch chamber in communication with the upper opening via the channel; and a button aperture in communication with the switch chamber;

a button inserted in the switch chamber via the button aperture, wherein the button comprises an abutment portion to keep the button in the box;

a switch comprising an arched portion extending in the switch chamber around the button, wherein the switch is operable to rotate the button by the abutment portion without hindering movement of the button into and from the button aperture of the box; and an engagement element inserted in the channel of the box and comprising a rear edge and a front edge, wherein the button is pressable to cause the abutment portion to move the engagement element in the channel to extend the front edge into the upper opening of the box.

2. The ratchet wrench according to claim 1, wherein the box comprises a restraining aperture in communication with the upper opening and a passageway via which the restraining aperture is in communication with the switch chamber, and the engagement element comprises a fin inserted in the passageway so that the engagement element is movable in the channel in a rectilinear manner.

3. The ratchet wrench according to claim 2, wherein the engagement element comprises an inclined face extending to the fin from the rear edge, and the abutment portion abuts against the inclined face of the engagement element to move the engagement element in the channel when the button is released.

4. The ratchet wrench according to claim 2, comprising a gear comprising teeth extending from an external side, wherein the box comprises a gear chamber to contain the gear, and the gear chamber is in communication with the upper opening via the restraining aperture.

5. The ratchet wrench according to claim 4, wherein the gear comprises an axle inserted in the restraining aperture of the box to facilitate the gear to spin smoothly in the gear chamber and keep the fin in the passageway.

6. The ratchet wrench according to claim 5, comprising a pawl inserted in the box and formed with two portions of teeth, wherein a selected one of the portions of teeth is engaged with teeth of the gear so that the box rotates the gear in a selected one of two senses of direction via the pawl and that the box cannot rotate the gear in the remaining one of the senses of direction via the pawl.

7. The ratchet wrench according to claim 6, wherein the box comprises a pawl chamber to contain the pawl, and the gear chamber is in communication with the switch chamber via the pawl chamber.

8. The ratchet wrench according to claim 7, comprising a rotor inserted in the box and comprising an arched flange, a radial protrusion and an elastic positioning element connected to the radial protrusion, wherein the rotor is rotatable by the switch to move the arched flange in the box, and the arched flange keeps the rotor in the box, and the pawl comprises a concave face to contain the elastic positioning element so that the radial protrusion moves the pawl to engage a selected one of the groups of teeth of the pawl with the teeth of the gear.

9. The ratchet wrench according to claim 8, wherein the box comprises a flange chamber to contain the arched flange, wherein the flange chamber is in communication with the switch chamber in an axial direction and in communication with the pawl chamber in a longitudinal direction of the box.

10. The ratchet wrench according to claim 8, comprising a compression spring sandwiched between the rotor and the button, wherein the compression spring tends to push the button out of the box.

11. The ratchet wrench according to claim 10, wherein the compression spring comprises an end inserted in a spring bore made in the button and another end located around a boss extending from the rotor.

12. The ratchet wrench according to claim 8, wherein the rotor comprises an arched ridge, and the switch comprises two pushers and a recess located between the pushers, and the arched ridge is located between the pushers when the arched ridge is inserted in recess so that the switch is operable to rotate the rotor.

13. The ratchet wrench according to claim 4, comprising an extensive element comprising an insert comprising an assembling inclined face at a free end of the insert, an annular groove, and a dismantling inclined face on a side of the annular groove, wherein the assembling inclined face pushes the engagement element away by the front edge in insertion of the insert into the gear, and the engagement element extends into the annular groove to keep the extensive element in the box, and the dismantling inclined face pushes the engagement element away by the front edge in pulling the insert from the gear.

14. The ratchet wrench according to claim 1, wherein the box comprises a slot in an upper face, the slot is in communication with the switch chamber, and the switch comprises a lever extending out of the box via the slot.

* * * * *